US011719434B2

(12) United States Patent
Chang et al.

(10) Patent No.: US 11,719,434 B2
(45) Date of Patent: Aug. 8, 2023

(54) GAS SAFETY DEVICE USING LOW POWER TO CONTROL HIGH FLOW

(71) Applicant: SEVEN UNIVERSE INDUSTRIAL CO., LTD., Taichung (TW)

(72) Inventors: Pao-Chi Chang, Taichung (TW); Ping-Yang Wu, Taichung (TW)

(73) Assignee: SEVEN UNIVERSE INDUSTRIAL CO., LTD., Taichung (TW)

( * ) Notice: Subject to any disclaimer, the term of this patent is extended or adjusted under 35 U.S.C. 154(b) by 174 days.

(21) Appl. No.: 17/130,032

(22) Filed: Dec. 22, 2020

(65) Prior Publication Data

US 2022/0065449 A1 Mar. 3, 2022

(30) Foreign Application Priority Data

Aug. 31, 2020 (TW) ..... 109129807

(51) Int. Cl.
*F23N 1/00* (2006.01)
*F23N 1/02* (2006.01)

(52) U.S. Cl.
CPC ..... *F23N 1/022* (2013.01); *F23N 2225/04* (2020.01); *F23N 2225/08* (2020.01); *F23N 2235/20* (2020.01); *F23N 2235/24* (2020.01)

(58) Field of Classification Search
CPC .. F23N 1/022; F23N 2225/08; F23N 2225/04; F23N 2235/20; F23N 2235/24
USPC ..... 431/12
See application file for complete search history.

(56) References Cited

U.S. PATENT DOCUMENTS

| | | | | |
|---|---|---|---|---|
| 4,406,400 A * | 9/1983 | Berkhof | F23N 1/007 236/92 A |
| 6,755,213 B1 | 6/2004 | Lai | |
| 7,523,762 B2 * | 4/2009 | Buezis | G05D 16/163 137/489 |
| 2012/0160186 A1 * | 6/2012 | Turrin | F23N 1/005 122/14.21 |

* cited by examiner

*Primary Examiner* — Avinash A Savani
(74) *Attorney, Agent, or Firm* — Demian K. Jackson; Jackson IPG PLLC

(57) ABSTRACT

The present invention provides a gas safety device using low power to control high flow, which includes a controller, a differential pressure regulating valve, and a driver, the controller can control if the gas can flow into the differential pressure regulating valve, the differential pressure regulating valve is connected to the controller, and can control if the gas can flow out for burning according to the gas pressure changes, the driver uses a drive piece to drive a micro switch lever inside the controller, so that the controller can output gas, thus, the present invention can control high gas flow with low power while maintaining safe usage of the gas.

7 Claims, 18 Drawing Sheets

GAS SAFETY DEVICE USING LOW POWER TO CONTROL HIGH FLOW

BACKGROUND OF INVENTION

1. Field of the Invention

The present invention relates generally to a gas appliance, and more particularly to a gas safety device using low power to control high flow.

2. Description of Related Art

The gas controller or valve used in a gas stove is usually called a gas switch. It mainly includes a main body and a shutter configured inside the main body in a rotatable manner. The inside of the main body and the shutter are both configured with gas flow channels. Through the change of the rotation angles of the shutter, the state of communication between the gas channel inside the main body and the gas channel inside the shutter can be changed, so as to control the gas switch to allow or not allow gas output and to change the flow rate of the gas output (i.e., to control the firepower). In the case of more advanced gas burning appliances like a fireplace or an oven, the gas controller or valve mainly includes a valve body and several solenoid valves configured on one side of the valve body. The inside of the valve body is configured with several gas flow channels that are respectively communicated with the gas flow channels of the solenoid valves. The solenoid valves are used to control the communication state of the gas flow channels inside the valve body, and thus to control if the gas can flow out from the valve body.

The various types of gas controllers or valves described above have been in use for years. Based on their respective advantages and disadvantages, they are used in different products as appropriate. However, when it comes to high flow control, none of above-mentioned conventional gas controllers or valves have sufficient gas tightness or operational accuracy and there is a necessity for improvement to enhance usage safety.

SUMMARY OF THE INVENTION

The main object of the present invention is to provide a gas safety device using low power to control high flow. It can use a low-power component to control high flow of gas output, and can ensure safety during the usage of gas. The high-flow gas output can be controlled simply with micro-power input. Hence, it has practical value.

Therefore, in order to achieve above objects, the present invention provides a gas safety device using low power to control high flow, which includes a controller, having a controller gas inlet and a controller gas outlet communicated with one end of the controller gas inlet. The controller gas inlet is connected to the gas source. A micro switch lever is movably configured on the controller gas inlet, and is connected to one end of the controller gas outlet. Through the first valve portion on its one end, the controller gas inlet can be controlled to be or not to be communicated with the controller gas outlet; a differential pressure regulating valve, including a gas inlet flow channel, a gas outlet flow channel, a diaphragm that can be pushed by the gas pressure (back pressure), and a valve body configured on one side of the diaphragm. Between the gas inlet flow channel and the gas outlet flow channel, a valve is configured. The gas outlet flow channel is connected to a gas burning appliance. The diaphragm is configured on one side of the gas outlet flow channel. The other side of the diaphragm is communicated with the controller gas outlet. One end of the valve body is configured with a second valve portion. The valve body goes through the valve gate, so that the second valve portion can shut the valve or open the valve, to control if the gas inlet flow channel can be communicated with the gas outlet flow channel; a driver, configured with a drive piece that is connected to the micro switch lever. Through displacement of the drive piece to drive the micro switch lever, the first valve portion can control if the controller gas inlet can be communicated with the controller gas outlet.

DETAILED DESCRIPTION OF THE INVENTION

Detailed descriptions of the present invention are provided below with reference to a plurality of preferred embodiments according to the present invention.

Figure 1:
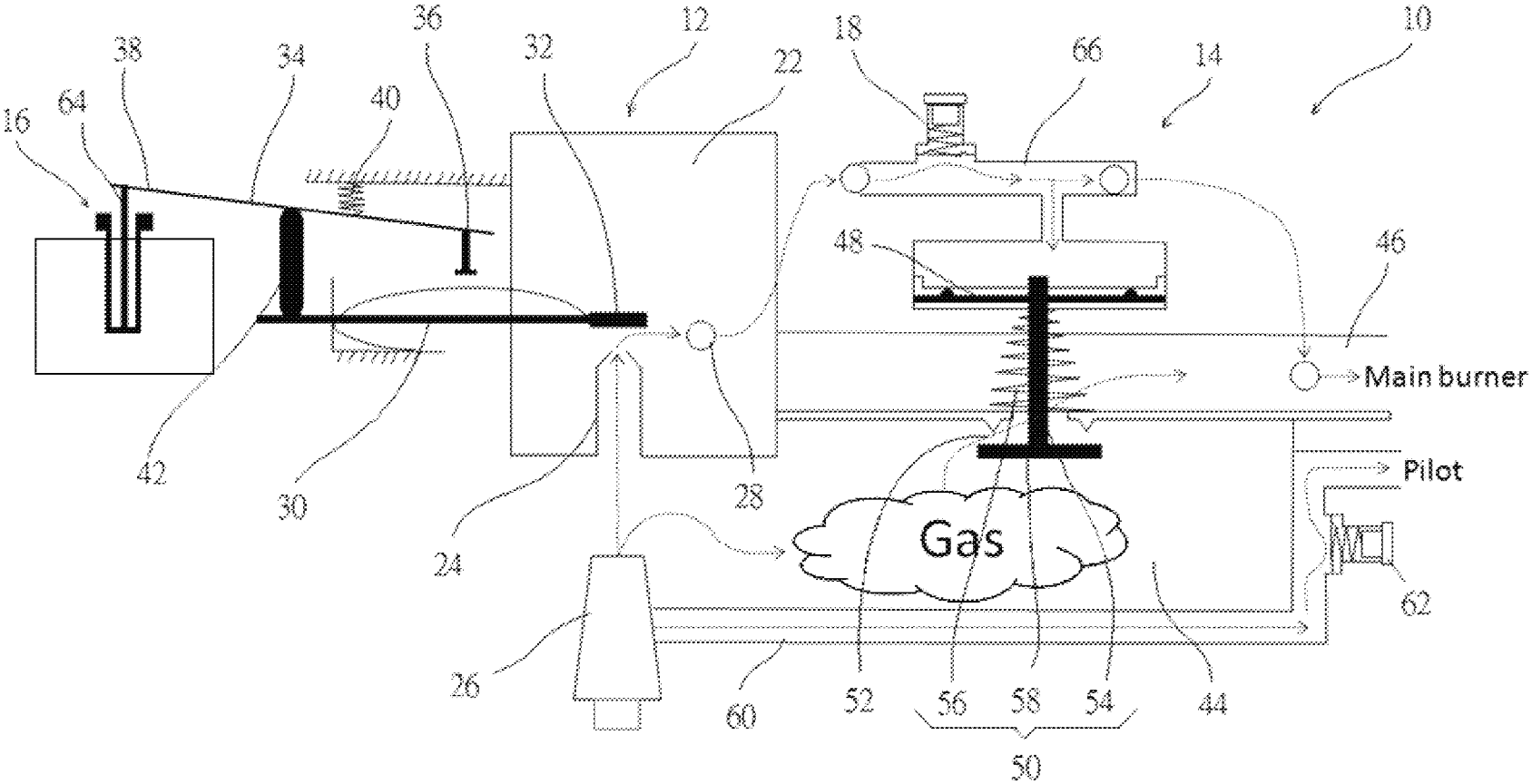
FIG. 1 is a schematic view of a first preferred embodiment according to the present invention.

Referring to FIG. 1, the gas safety device using low power to control high flow 10 disclosed in the first preferred embodiment of the present invention includes a controller 12, a differential pressure regulating valve 14, and a driver 16.

The controller 12 includes a main body 22, a controller gas inlet (or back pressure gas inlet channel) 24, configured on one end of the main body 22, a gas inlet valve (e.g. the shutter in the prior-art gas switch) 26, configured on the controller gas inlet 24 and connected to the gas source, which is LPG gas source in the present embodiment (not shown in the drawings), a controller gas outlet 28, configured on one side of the main body 22, with its one end communicated with the controller gas inlet 24, a micro switch lever 30, movably configured on one side of the main body 22, with its one end inside the main body 22 configured with a first valve portion 32, and the first valve portion 32 being located on the end of the controller gas inlet 24 connecting the controller gas outlet 28, a transmission lever 34, having a pivotal connecting end 36 and a deflection end 38, the pivotal connecting end 36 being pivotally connected on one side of the main body 22, an elastic piece 40, pushed against one side of the transmission lever 34, to provide a pushing force to push the transmission lever 34 to deflect downward, and meanwhile to provide a pre-pressure to maintain contact between the transmission lever 34 and the driver 16, a link 42, with its one end pivotally connected to the transmission lever 34, and the other pivotally connected to the micro switch lever 30. When the transmission lever 34 deflects, it can drive the micro switch lever 30 to rise or descend, so that the first valve portion 32 can control if the controller gas inlet 24 is communicated with the controller gas outlet 28. Inside the controller gas outlet 28, a throttle nozzle can be configured (not shown in the drawings) for gas flow adjustment.

The differential pressure regulating valve 14 configured on one side of the controller 12 is similar to the pressure disc in the prior-art water heater, including a gas inlet flow channel 44, a gas outlet flow channel 46, a diaphragm that can be pushed by the gas pressure (back pressure) 48, and a valve body 50 configured on one side of the diaphragm 48. The gas inlet flow channel 44 is connected to the gas inlet valve 26, and between the gas inlet flow channel 44 and the gas outlet flow channel 46, a valve is configured 52. The gas outlet flow channel 46 is connected to a gas burner, which is a gas appliance (can be any prior-art gas burning appliances) in the present embodiment. The diaphragm 48 and valve body 50 is similar to the control member inside the prior-art pressure disc. The diaphragm 48 is configured on the top side of the gas outlet flow channel 46. The top side of the diaphragm 48 is communicated with the gas outlet channel 28. The valve body 50 includes a shaft lever 54, a spring 56 sleeved on the shaft lever 54, and a second valve portion 58. The second valve portion 58 is configured on the bottom end of the shaft lever 54. The shaft lever 54 goes through the valve gate 52, so that the second valve portion 58 can shut the valve 52 or open the valve 52, to control if the gas inlet flow channel 44 can be communicated with the gas outlet flow channel 46. The spring 56 enables the second valve portion 58 to seal the valve 52 when the diaphragm 48 is not pushed by the gas pressure (back pressure). One side of the differential pressure regulating valve 14 is configured with a prior-art pilot flow channel 60 (it is also fine not to have such a configuration). The pilot flow channel 60 is connected to the gas inlet valve 26 and the gas appliance, to provide pilot fire to ignite the gas appliance. Its one side is further configured with a pressure regulating device 62 (it is also fine not to have such a configuration).

The driver 16 is a prior-art temperature sensor, configured at an appropriate position in the water to be heated by the gas appliance. Its configuration is not detailed herein. It has a drive piece 64 (i.e., temperature probe component). The drive piece 64 is pushed against deflection end 38 of the transmission lever 34. When the heating temperature is normal, the drive piece 64 will stick out (when it is not too hot), and when the heating temperature is too high, the drive piece 64 will draw back. Through the displacement of the tip end of the drive piece 64 along with temperature changes, the micro switch lever 30 will be pushed or not be pushed. Thus, the first valve portion 32 can control if the controller gas inlet 24 can be communicated with the controller gas outlet 28.

In addition, a back pressure regulator 18 is further provided. The back pressure channel 66 is connected between the controller gas outlet 28 of the controller 12 and the diaphragm 48, i.e., one end of the back pressure channel 66 is connected to the controller gas outlet 28, and the other end is connected to one side of the diaphragm 48, so as to regulate the back pressure of gas on the diaphragm 48. Also, one end of the back pressure channel 66 is further communicated with the gas outlet flow channel 46.

Thus, when the gas safety device 10 according to the present invention is connected to a gas source, through the combination of the controller 12, the differential pressure regulating valve 14 and the driver 16, it can control high gas flow with lower power while maintaining safe of gas supply. The operations of the present invention are detailed below:

When the gas appliance is under a normal heating condition, the drive piece 64 will stick out to push the deflection end 38 of the transmission lever 34. At this point, the micro switch lever 30 is not pushed by the link 42, the inner end of the gas inlet channel 24 is not shut off by the first valve portion 32, and gas can pass through the gas inlet valve 26 and the controller gas inlet 24 and flow to the controller gas outlet 28 (the gas also pass through the gas inlet valve 26 and flow into the gas inlet flow channel 44 and the pilot flow channel 60. The gas flowing into the pilot flow channel 60 can be used as the pilot to ignite the gas appliance), and then pass through the controller gas outlet 28 and flow into the back pressure regulator 18, and further into the space above the diaphragm 48 to generate back pressure. The increasing back pressure will push the valve body 50 to open the valve 52, and the gas inside the gas inlet flow channel 44 can pass through the valve 52, and flow out from the gas outlet flow channel 46 to be burned by the gas appliance. In addition, the end of the back pressure channel 66 communicated with the gas outlet flow channel 46 is used as a pressure-relief pathway that is constantly open. A throttle nozzle (not shown in the drawings) can be provided together with the back pressure regulator 18 for flow regulation.

Figure 2:
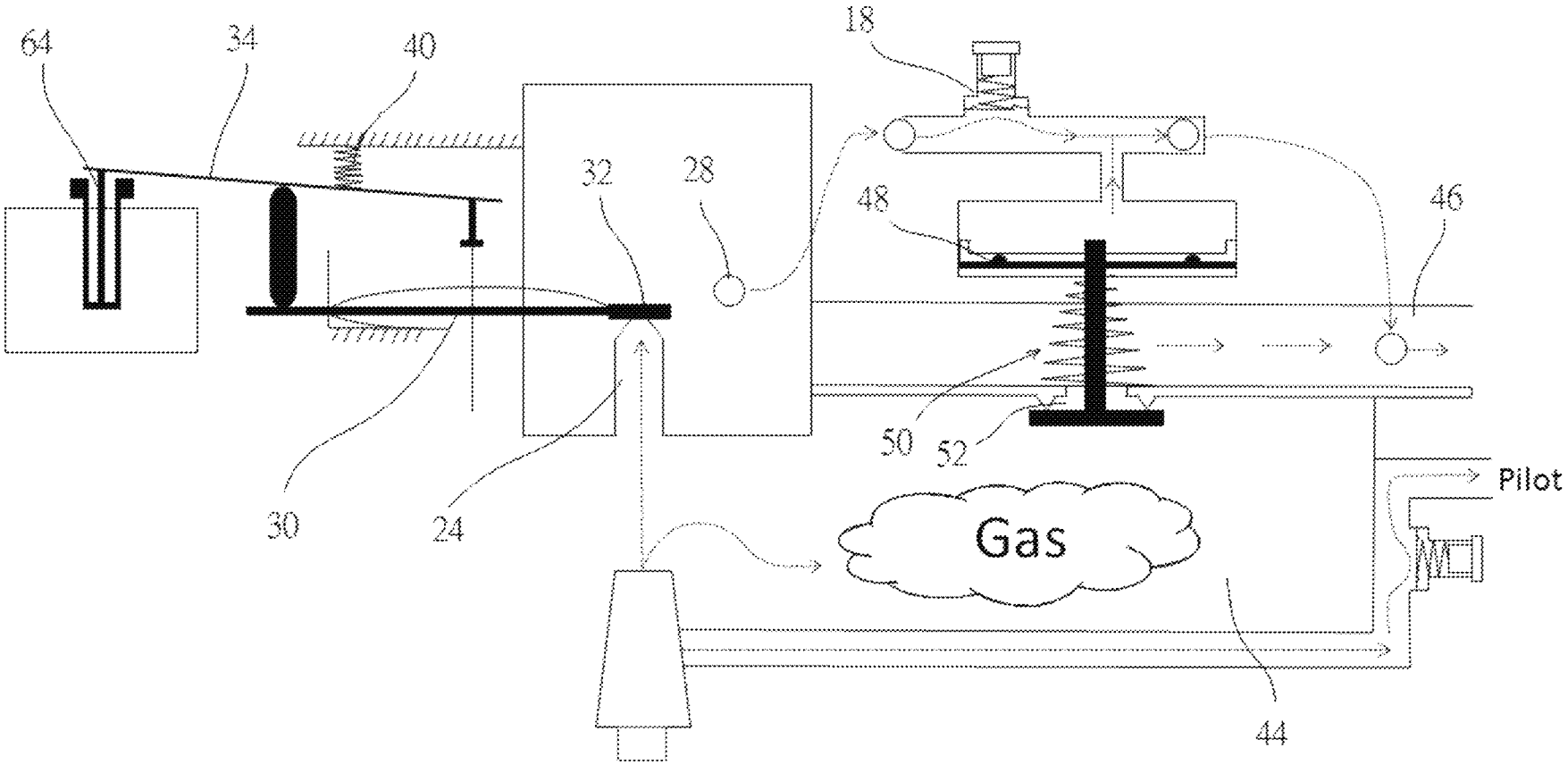
FIG. 2 is an operational view of a first preferred embodiment according to the present invention.

Further referring to FIG. 2, when the temperature is too high, the drive piece 64 will draw back and no longer push the transmission lever 34. Now the micro switch lever 30 will descend under the tension of the elastic piece 40, so that the first valve portion 32 will shut off the inner end of the controller gas inlet 24. At this point, the gas inside the controller gas outlet 28 and the back pressure regulator 18 will flow to the gas outlet flow channel 46 and be discharged and burned. And as the valve body 50 is not pushed by the diaphragm 48, it can recover and close the valve 52, so that the gas inside the gas inlet flow channel 44 can not flow into the gas outlet flow channel 46. Gas supply to the gas appliance is thus stopped.

Figure 3:
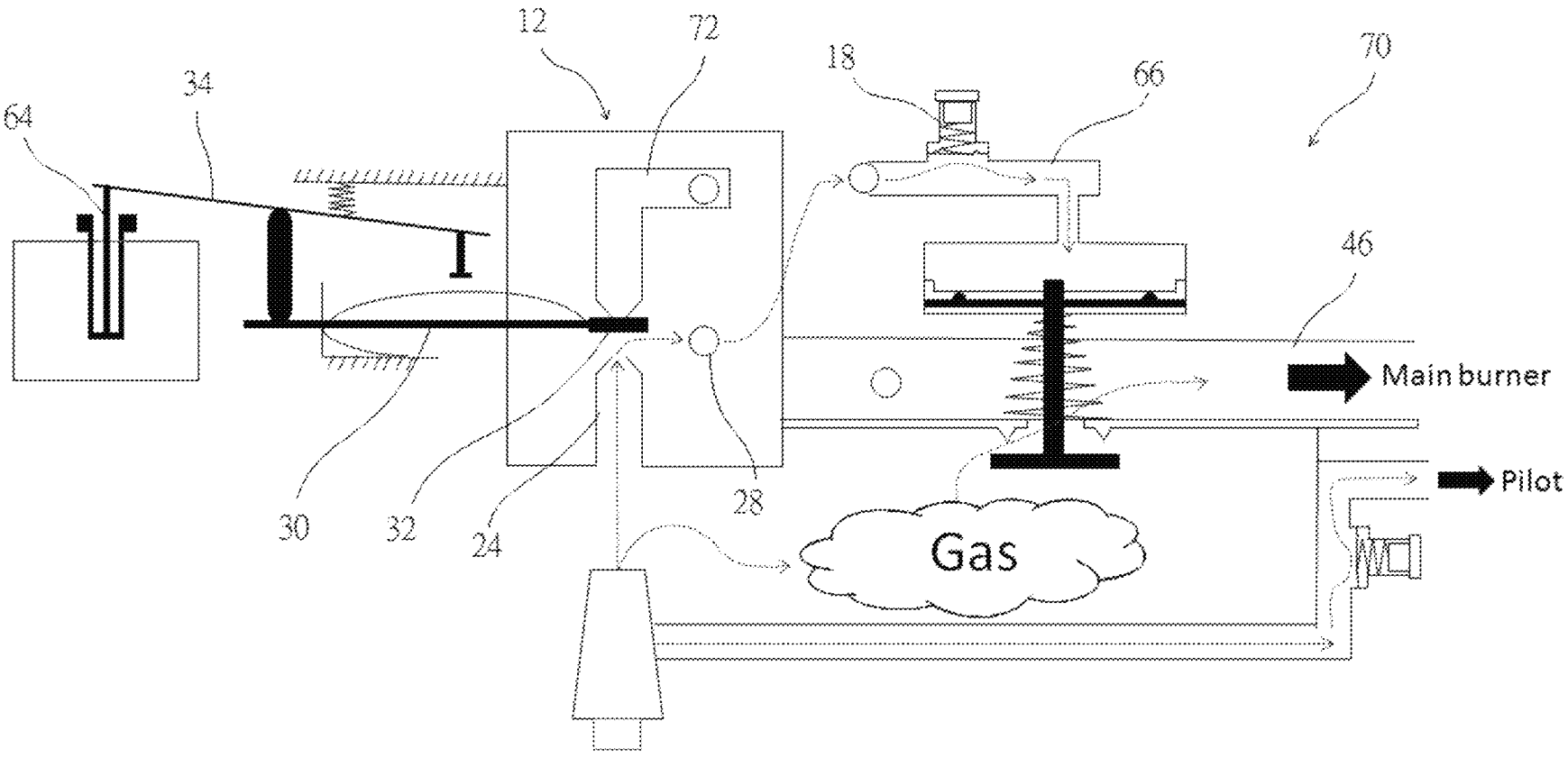
FIG. 3 is a schematic view of a second preferred embodiment according to the present invention.

FIG. 3 shows gas safety device 70 as a second preferred embodiment of the present invention. Its configuration is similar to gas safety device 10. Same notations are used for the same components. The differences are: the controller 12 further includes an internal pathway 72. One end of the internal pathway 72 corresponds to the controller gas inlet 24 and is communicated with the controller gas outlet 28 and the gas outlet flow channel 46. The micro switch lever 30 is movably configured at the position where the controller gas inlet 24 and the internal pathway 72 connect with the controller gas outlet 28. The first valve portion 32 can also control if the internal pathway 72 can be communicated with the controller gas outlet 28. One end of the back pressure channel 66 is not communicated with the gas outlet flow channel 46.

Figure 4:
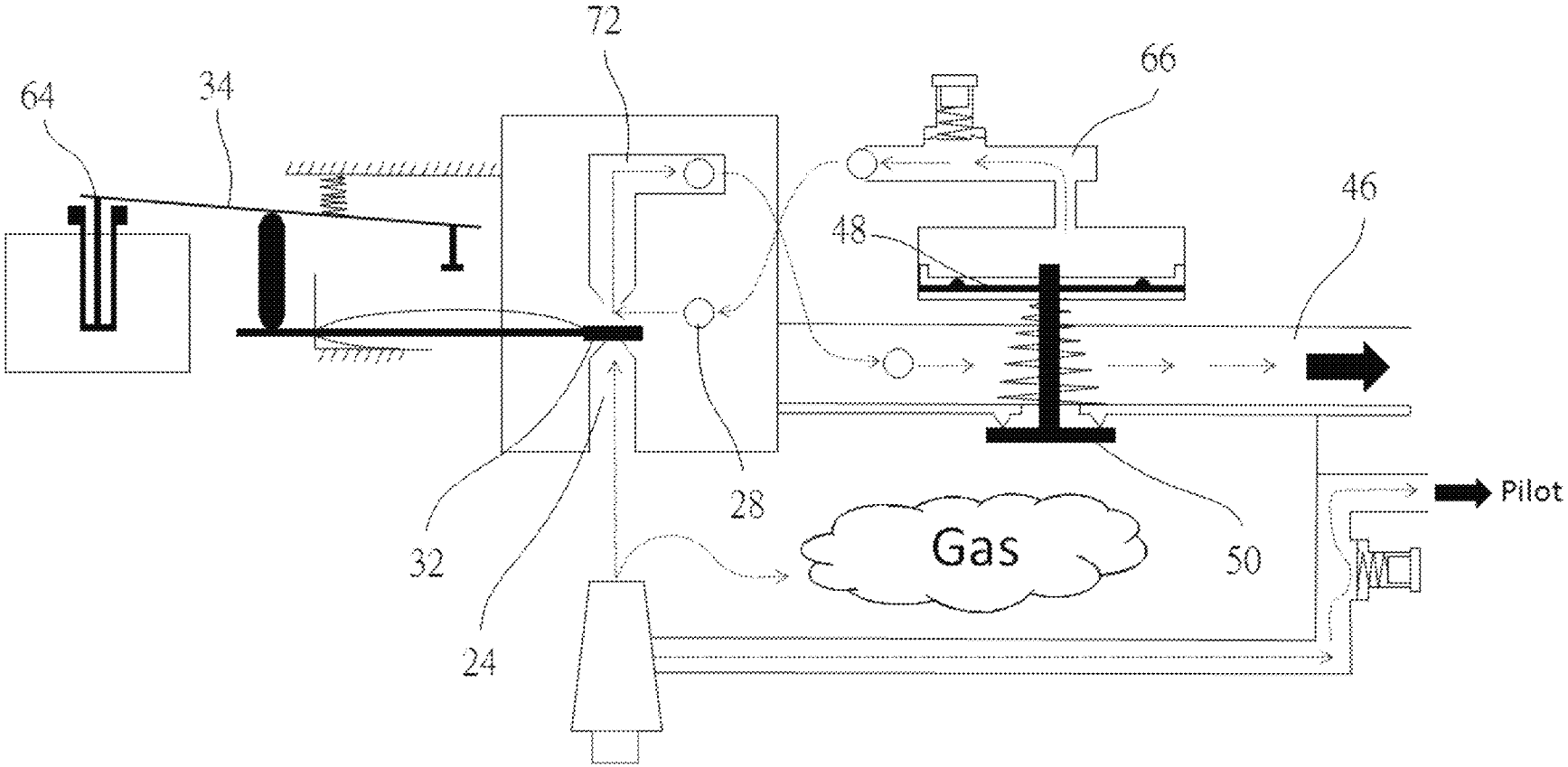
FIG. 4 is an operational view of a second preferred embodiment according to the present invention.

Thus, as described above, when the gas appliance is under a normal heating condition, the drive piece 64 will stick out to push the deflection end 38 of the transmission lever 34. At this point, the micro switch lever 30 is not pushed by the link 42, and the inner end of the controller gas inlet 24 is not closed by the first valve portion 32, but the end of the internal pathway 72 communicated with the controller gas outlet 28 is closed. The state of gas flow is similar to what is described above. When the temperature is too high, the drive piece 64 will draw back. As shown in FIG. 4, the first valve portion 32 closes the inner end of the controller gas inlet 24, but no longer closes the end of the internal pathway 72 communicated with the controller gas outlet 28. The back pressure gas in the space above the diaphragm 48 will pass through the controller gas outlet 28 and flow upstream into the internal pathway 72, and then into the gas outlet flow channel 46, and be burned by the gas appliance. And as the valve body 50 is not pushed by the diaphragm 48, it can recover and close the valve 52, so that the gas inside the gas inlet flow channel 44 can not flow into the gas outlet flow channel 46. Gas supply to the gas appliance is thus stopped without any gas residue.

Figure 5:
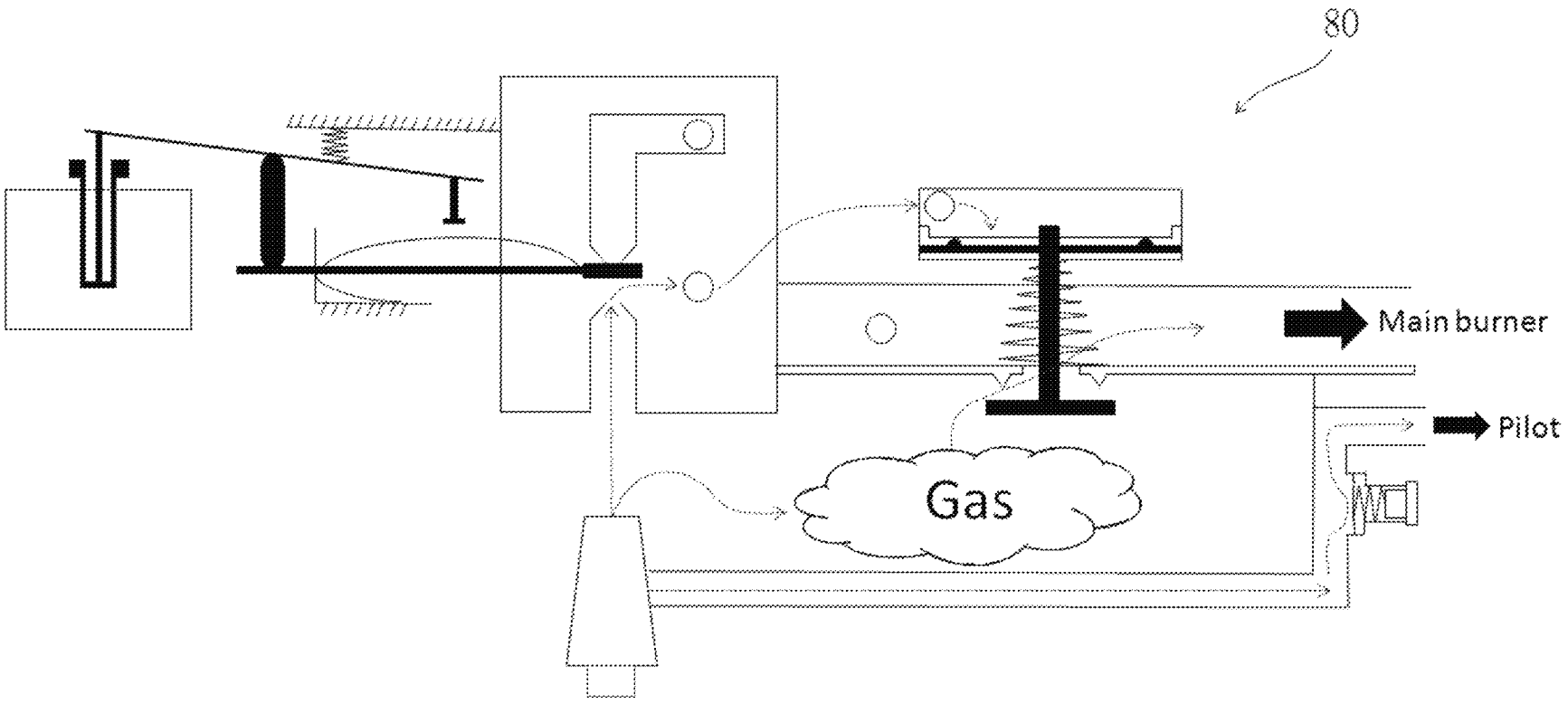
FIG. 5 is a schematic view of a third preferred embodiment according to the present invention.
Figure 6:
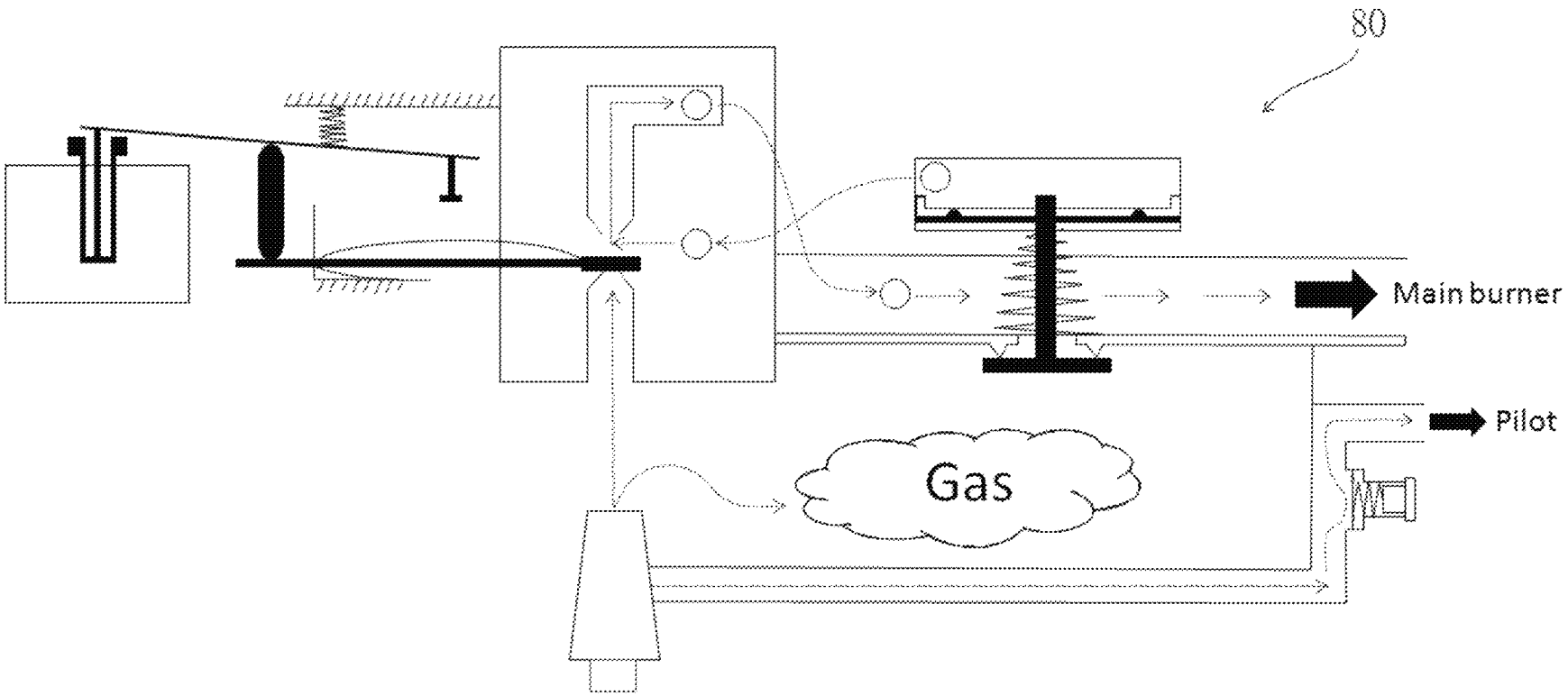
FIG. 6 is an operational view of a third preferred embodiment according to the present invention.

FIG. 5 and FIG. 6 show a gas safety device 80 as a third preferred embodiment of the present invention. Its configuration is similar to gas safety device 70. The only difference is that it does not have the configuration of a back pressure regulator 18. Therefore, the gas flowing path and relevant controlling actions of the gas safety device 80 are similar to the gas safety device 70, only without flow and regulation of the back pressure gas.

Figure 7:
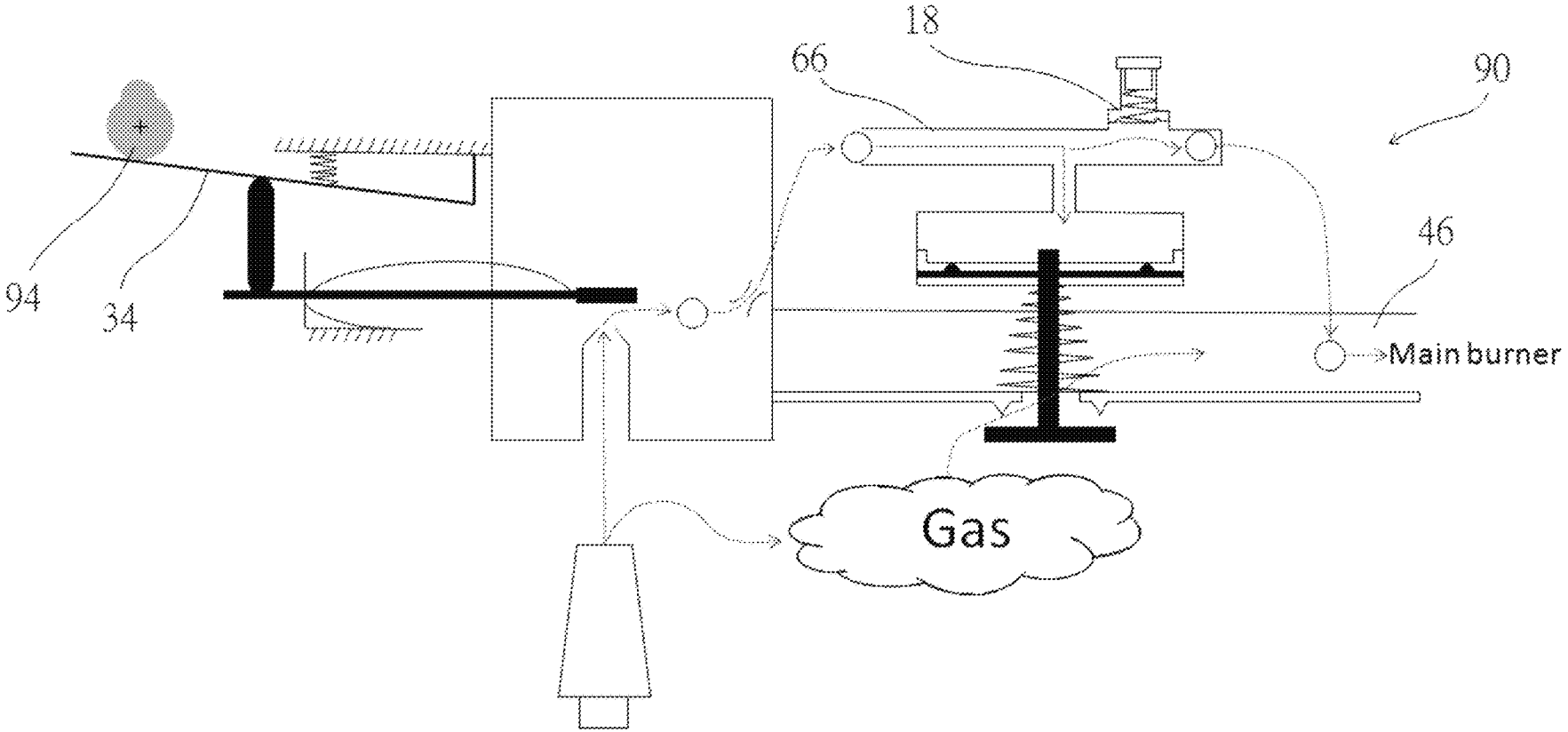
FIG. 7 is a schematic view of a fourth preferred embodiment according to the present invention.
Figure 8:
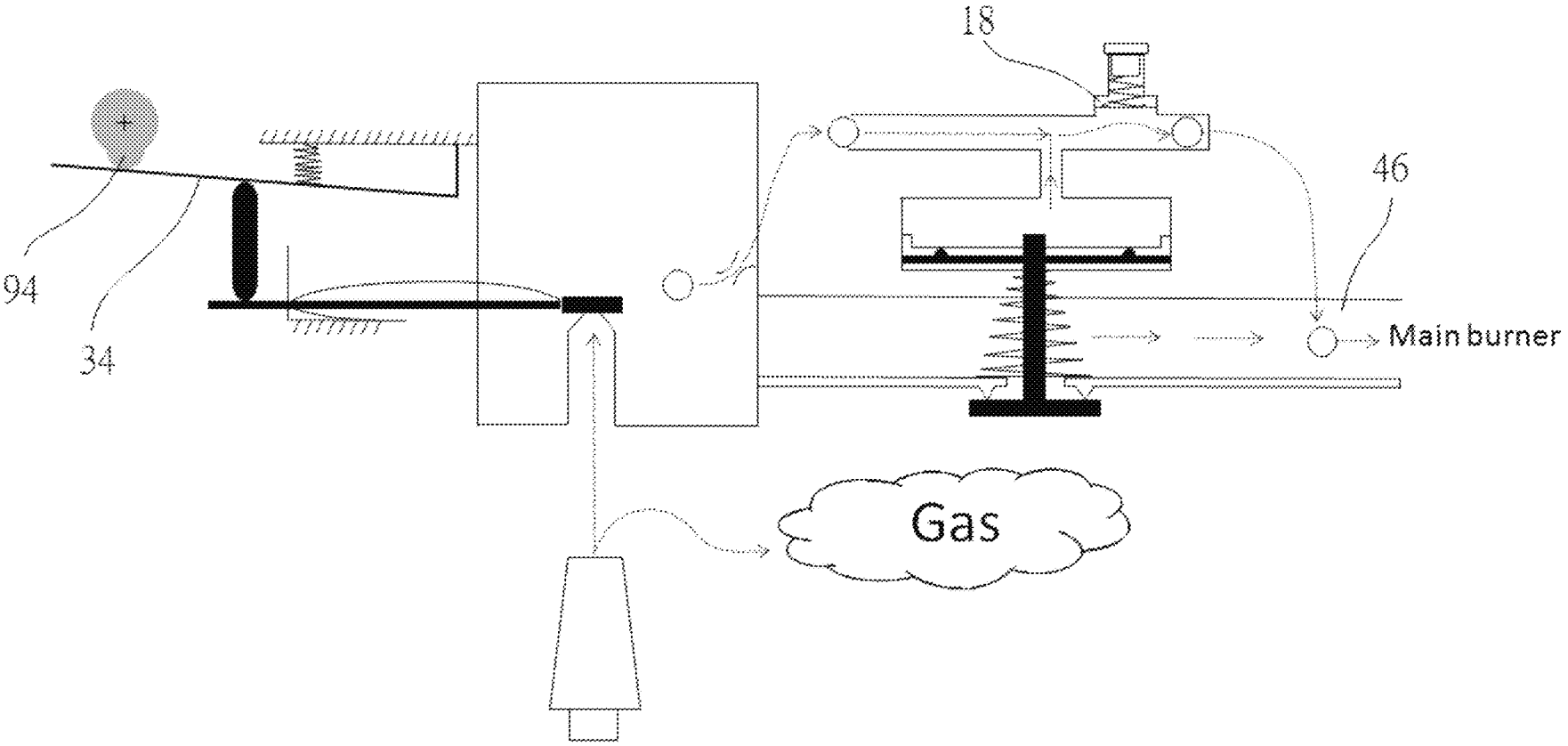
FIG. 8 is an operational view of a fourth preferred embodiment according to the present invention.

FIG. 7 and FIG. 8 show a gas safety device 90 as a fourth preferred embodiment of the present invention. Its configuration is similar to gas safety device 10, with the following deference: its driver 92 is a prior-art mechanical timer; its drive piece 94 is configured on the cam on one end of the timer rotor, and there is no pilot flow channel 60 or pressure regulating device 62; the back pressure regulator 18 is located on one side of the back pressure channel 66 connecting the gas outlet flow channel 46. Thus, a period of time can be set for the driver 92 (for example, 1, 2 or 3 hours). When the gas safety device 90 is rotated, the outer diameter of the drive piece 94 will change (i.e., a displacement is produced in relation to the transmission lever 34). As a result, the transmission lever 34 is pushed or not pushed (at this time, the micro switch lever 30 and the link 42 can also be combined into the same component). Thus, the controlling actions to start or stop the gas supply like the gas safety device 10 can be achieved. Moreover, the driver (timer) also has a function to be constantly on. And when the driver is relatively far from the transmission lever 34, a transmission component (such as a flexible transmission member) to link the drive piece 94 and the transmission lever 34 together, so that the drive piece 94 can drive the transmission lever 34 through the transmission component.

Figure 9:
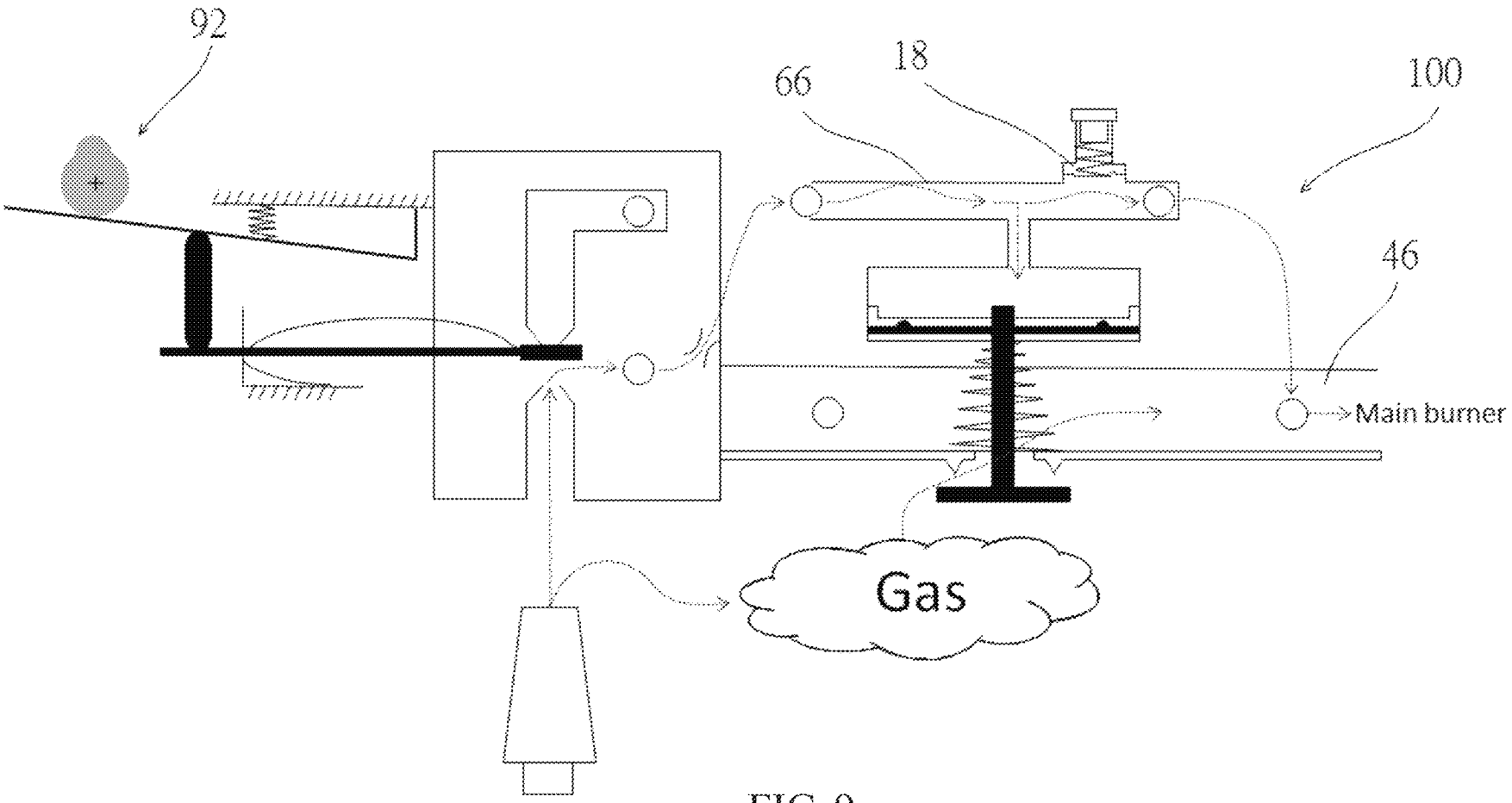
FIG. 9 is a schematic view of a fifth preferred embodiment according to the present invention.
Figure 10:
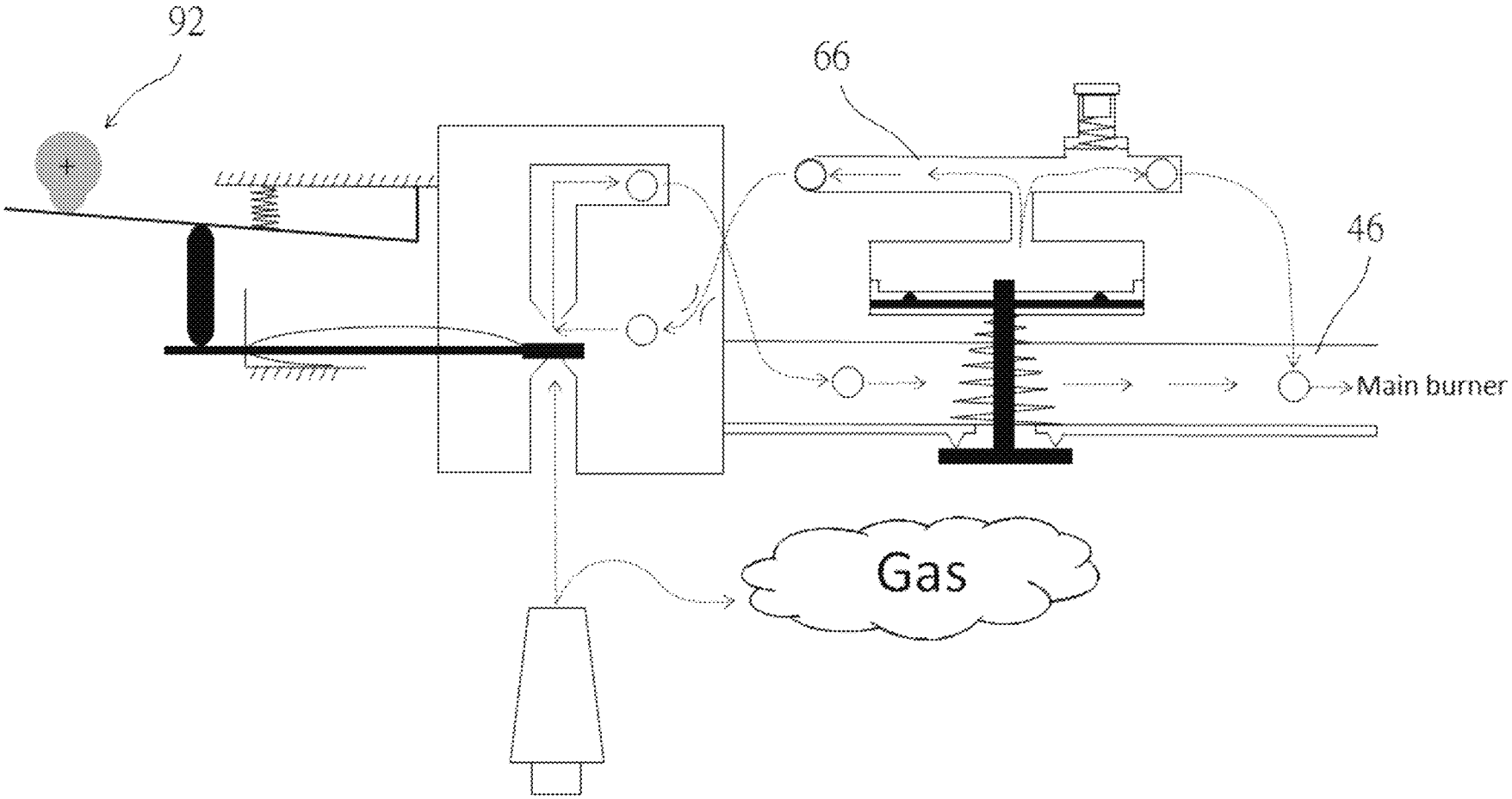
FIG. 10 is an operational view of a fifth preferred embodiment according to the present invention.

FIG. 9 and FIG. 10 show gas safety device 100 as a fifth preferred embodiment of the present invention, wherein, the temperature-sensing driver 16 in the gas safety device 70 is replaced by a timer driver 92 as in gas safety device 90. The back pressure regulator 18 is located on one side of the back pressure channel 66 connecting the gas outlet flow channel 46. When the gas safety device 100 is running, the back pressure can be quickly released, and the gas remaining on one side of the diaphragm 48 (back pressure chamber) can be quickly reduced. Thus, the controlling actions and effects to start or stop the gas supply like the gas safety device 10 can be achieved, and the back pressure can be quickly released, with faster valve shutting than gas safety device 90.

Figure 11:
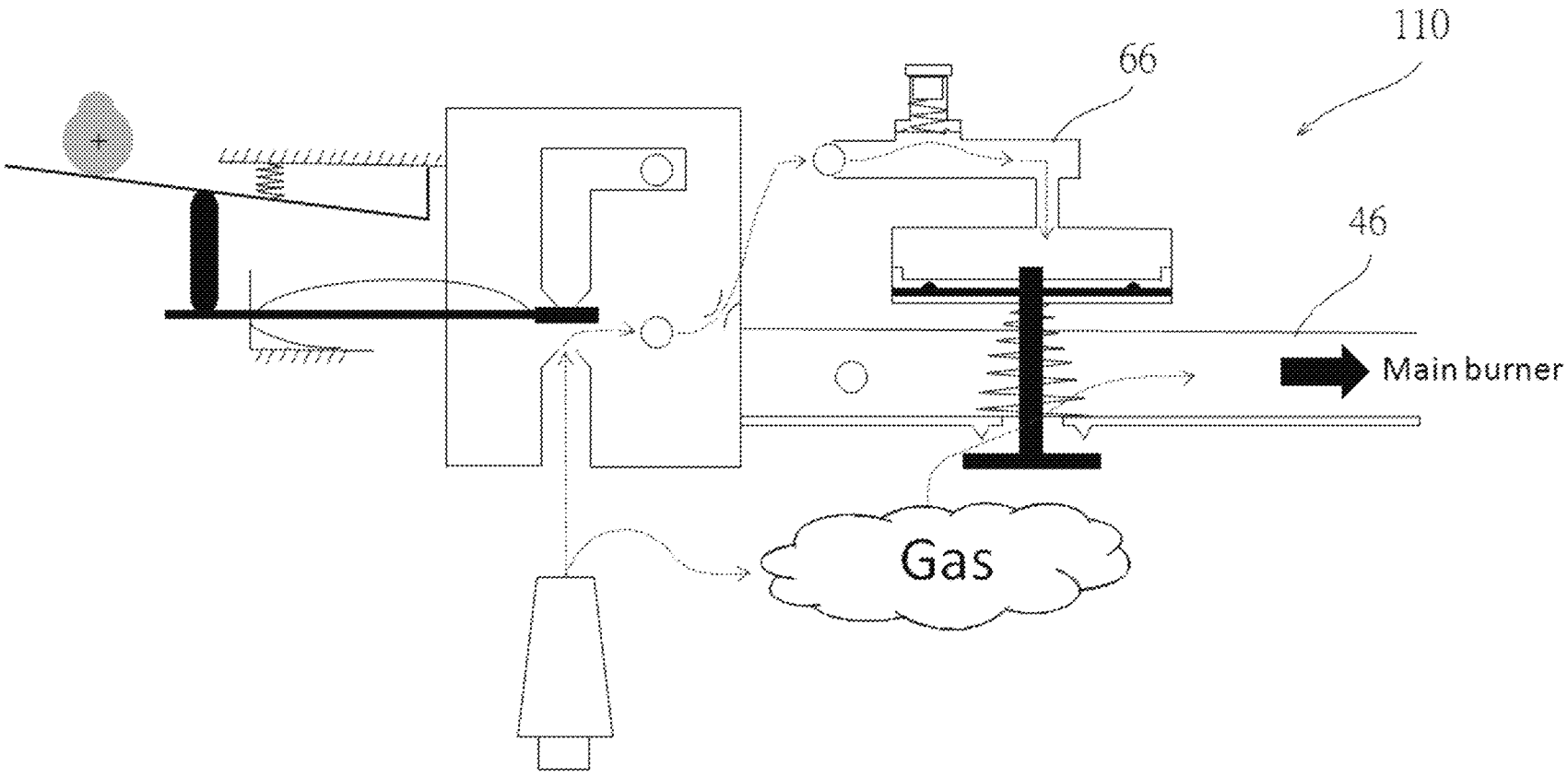
FIG. 11 is a schematic view of a sixth preferred embodiment according to the present invention.
Figure 12:
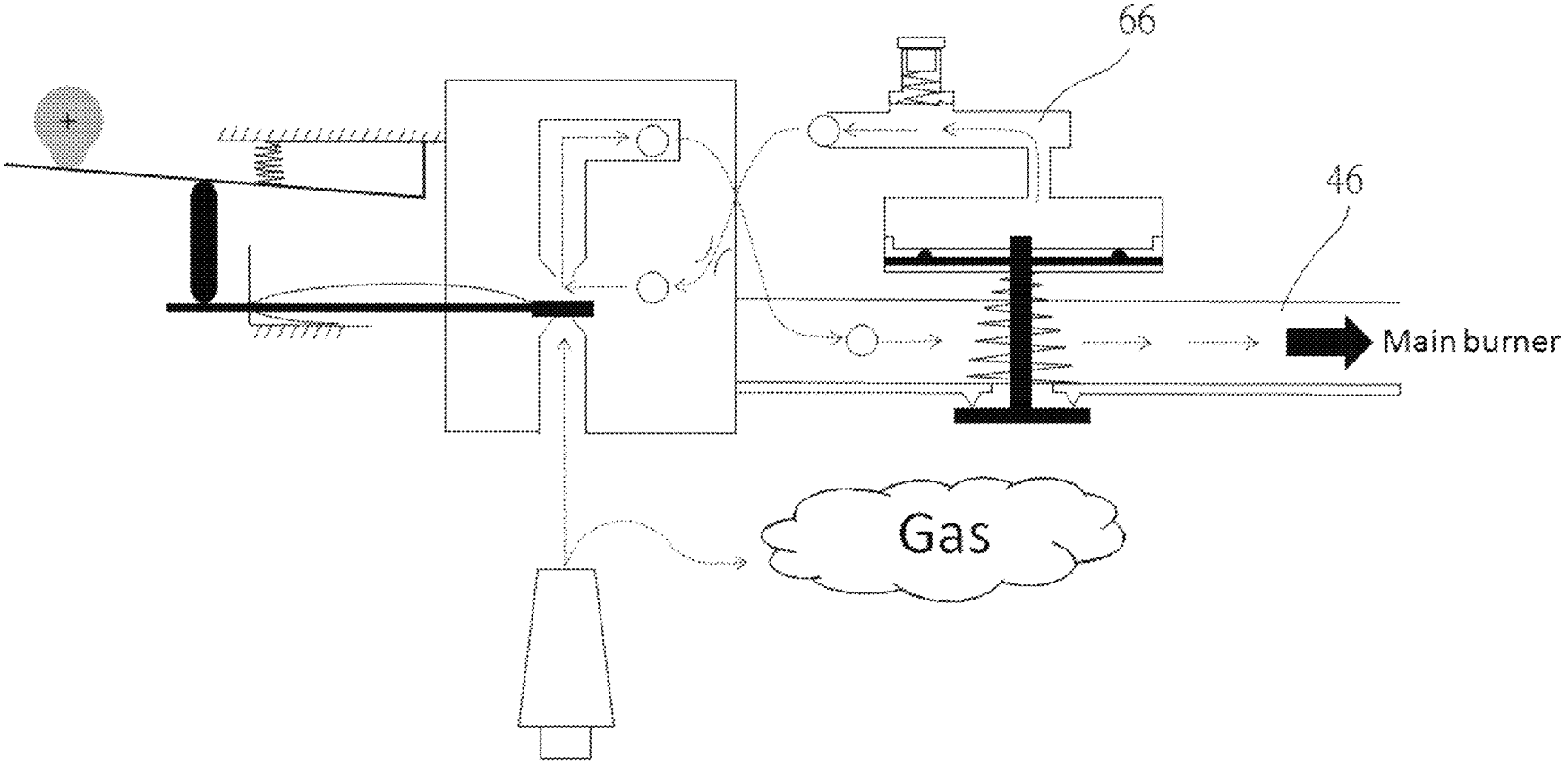
FIG. 12 is an operational view of a sixth preferred embodiment according to the present invention.

FIG. 11 and FIG. 12 show gas safety device 110 as a sixth preferred embodiment of the present invention. Its configuration is similar to gas safety device 100, only with the following difference: one end of the back pressure channel 66 is not communicated with the gas outlet flow channel 46.

Figure 13:
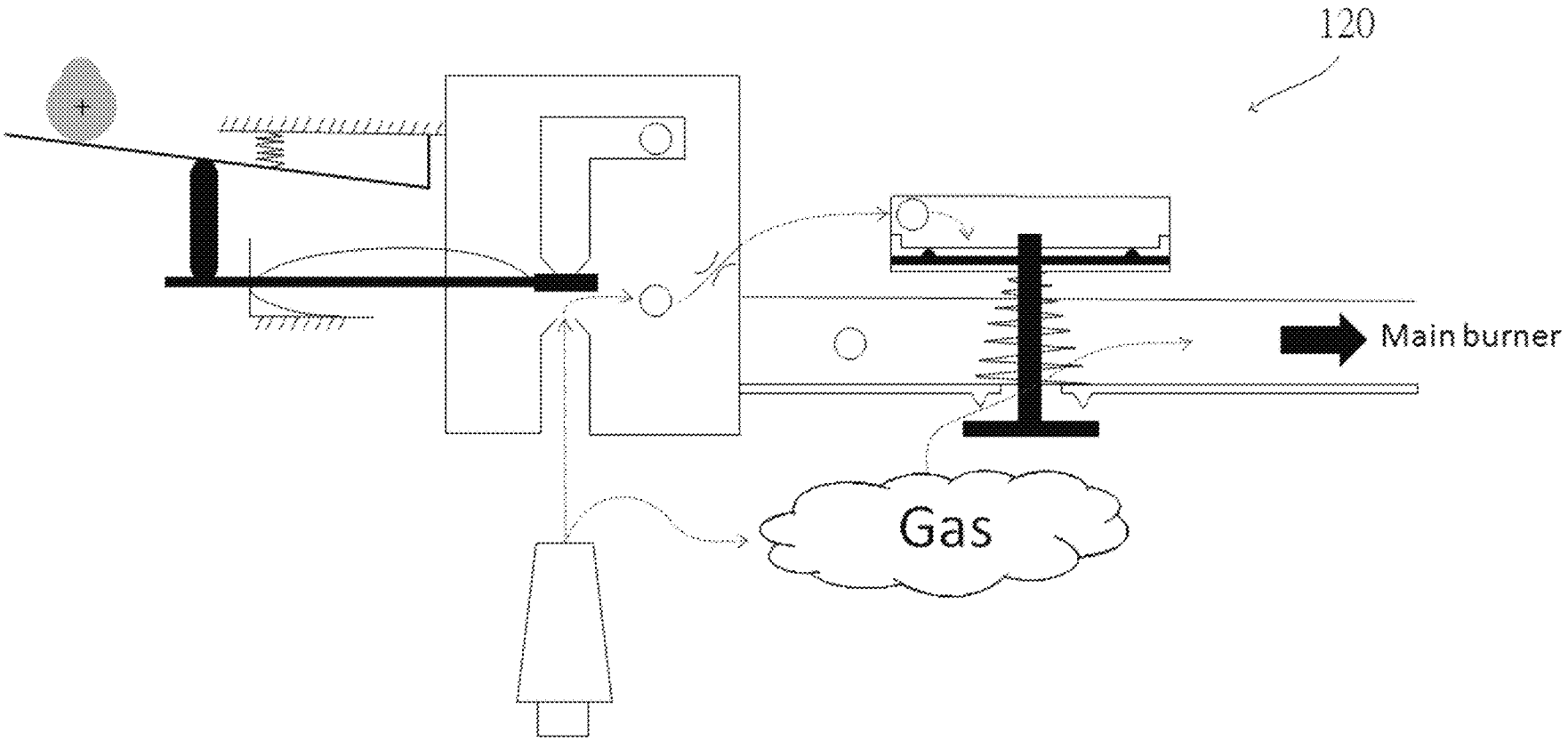
FIG. 13 is a schematic view of a seventh preferred embodiment according to the present invention.
Figure 14:
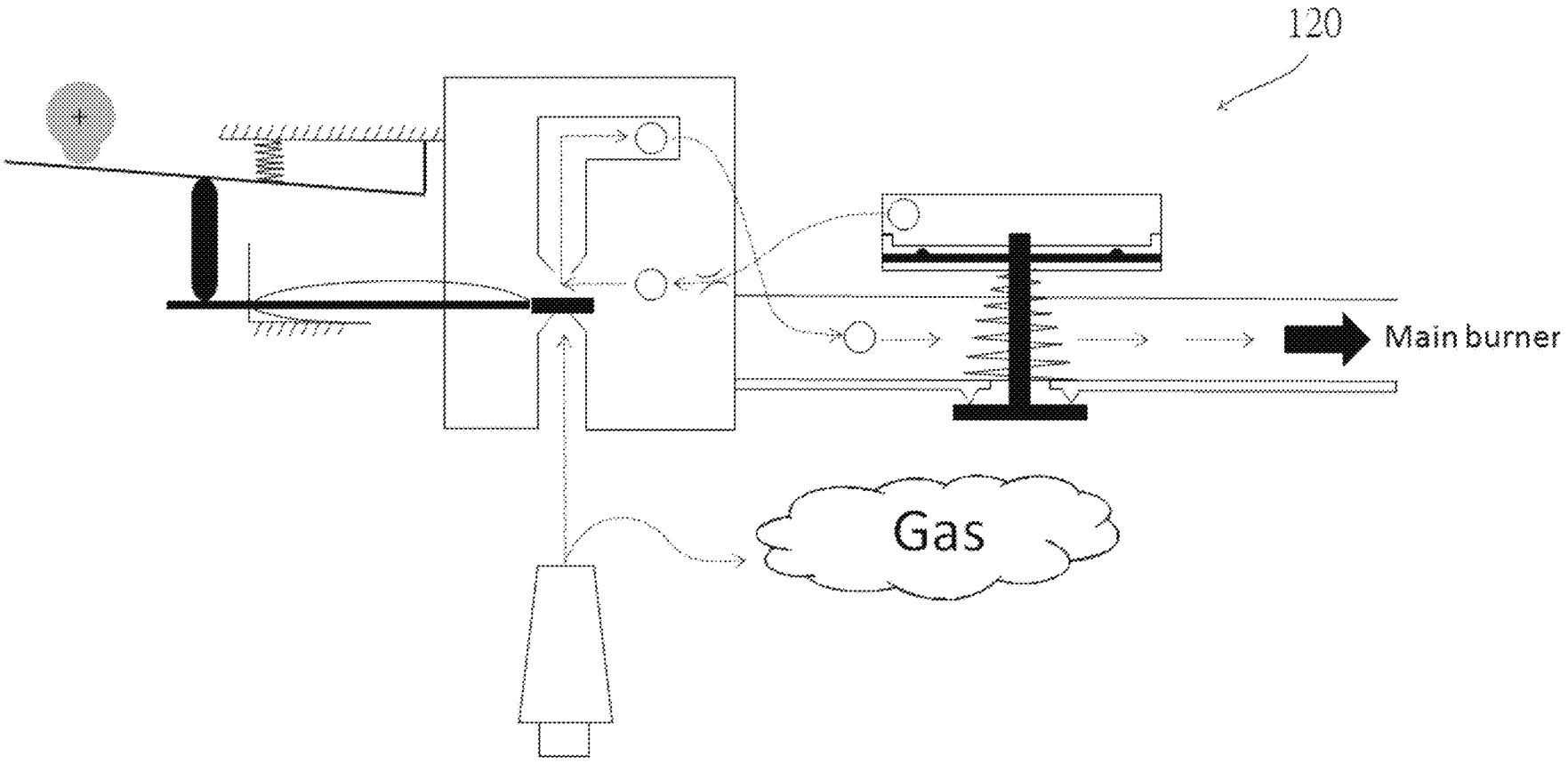
FIG. 14 is an operational view of a seventh preferred embodiment according to the present invention.

FIG. 13 and FIG. 14 show gas safety device 120 as a seventh preferred embodiment of the present invention. Its configuration is similar to gas safety device 110, with only the following difference: there is no back pressure regulator 18. Thus, the gas flowing path and the relevant controlling actions of gas safety device 120 is the same as gas safety device 70, only without flow and regulation of back pressure gas.

Figure 15:
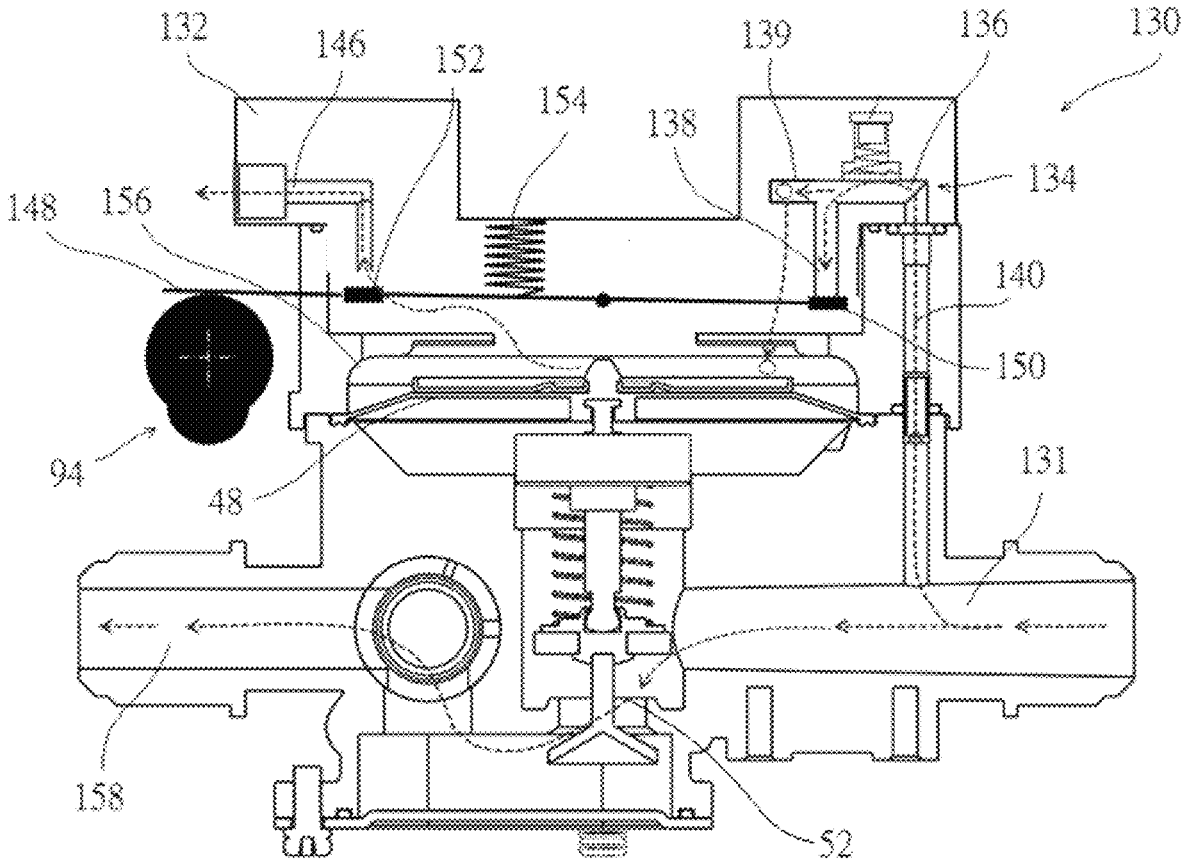
FIG. 15 is a schematic view of an eighth preferred embodiment according to the present invention.
Figure 16:
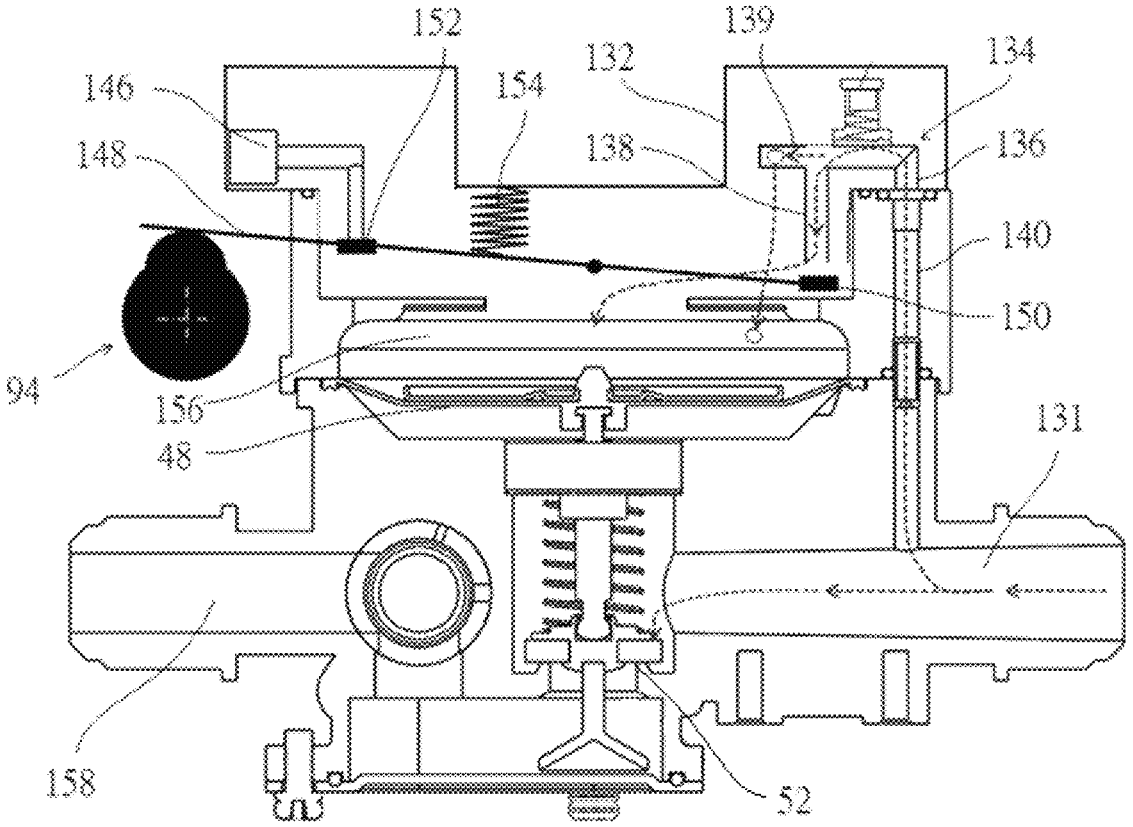
FIG. 16 is an operational view of an eighth preferred embodiment according to the present invention.

FIG. 15 and FIG. 16 show gas safety device 130 as an eighth preferred embodiment of the present invention. Its configuration is similar to gas safety device 110, with the following differences: the above-mentioned gas inlet flow channel 44 is omitted, and the gas outlet flow channel 46 is used as the gas inlet flow channel (notation is changed to 131). The controller 132 is fixed on the top side of the diaphragm 48. The internal pathway 134 on one end of the inside of the controller 132 is configured with a gas inlet end 136, a first gas outlet end 138, and a second gas outlet end 139. The gas inlet end 136 is communicated with the controller gas inlet 140. The controller gas inlet 140 is connected to the gas inlet flow channel 131. The controller gas outlet 146 is configured on one end of the inside of the controller 132. The controller gas outlet 146, the first gas outlet end 138, and the second gas outlet end 139 are communicated with one side of the diaphragm 48, to provide gas back pressure. The middle portion of the micro switch lever 148 is pivotally connected on the inside of the controller 132, with the two ends capable of rotation around the pivot point. The first valve portion 150 is configured on one end of the micro switch lever 148 and corresponds to the first gas outlet end 138. The other end of the micro switch lever 148 sticks out of the controlling portion 132 and is pushed against the drive piece 94. The end of the micro switch lever 148 sticking out of the controlling portion 132 is further configured with a third valve portion 152 corresponding to the controller gas outlet 146. The elastic piece 154 is pushed against one side of the micro switch lever 148, so that, when the micro switch lever 148 is not pushed by the drive piece 94, the first gas outlet end 138 is closed by the first valve portion 150, while the controller gas outlet 146 is not closed by the third valve portion 152, when the drive piece 94 pushes the micro switch lever 148, the third valve portion 152 closes the controller gas outlet 146, while the first gas outlet end 138 is not closed by the first valve portion 150. The back pressure regulator 18 is connected to one side of the internal pathway 134, and one side of the diaphragm 48 is configured with a cover plate 156. The first gas outlet end 138 and the second gas outlet end 139 are communicated with the inner side of the cover plate 156 to provide the diaphragm 48 with back pressure.

Thus, when the driver 92 is timed, the micro switch lever 148 is not pushed by the drive piece 94, and the controller gas outlet 146 is not closed by the third valve portion 152, while the first gas outlet end 138 is closed by the first valve portion 150, gas can go from the gas inlet flow channel 131, passing through the controller gas inlet 142, the internal pathway 134, and flow to the internal side of the cover plate 156 from the second gas outlet end 139. The gas on the internal side of the cover plate 156 will then flow out from the controller gas outlet 146, while the gas flow in from the gas inlet flow channel 131 will pass through the valve 52, and flow out from the other gas outlet flow channel 158.

When the set time is over, the micro switch lever 148 is pushed by the drive piece 94, causing the third valve portion 152 to close the controller gas outlet 146, while the first gas outlet end 138 is not closed by the first valve portion 150, gas from the gas inlet flow channel 144 will pass through the controller gas inlet 142, the internal pathway 134, the first gas outlet end 138 and the second gas outlet end 139, and flow to the internal side of the cover plate 156, producing back pressure to push the diaphragm 48, so that the second valve portion 58 of the valve body 50 can close the valve 52 and stop supplying gas for burning by the gas appliance. In other words, the gas back pressure drives the diaphragm 48 to control if the valve body 50 close the valve 52. Such a method is contrary to the above-mentioned embodiment.

Figure 17:
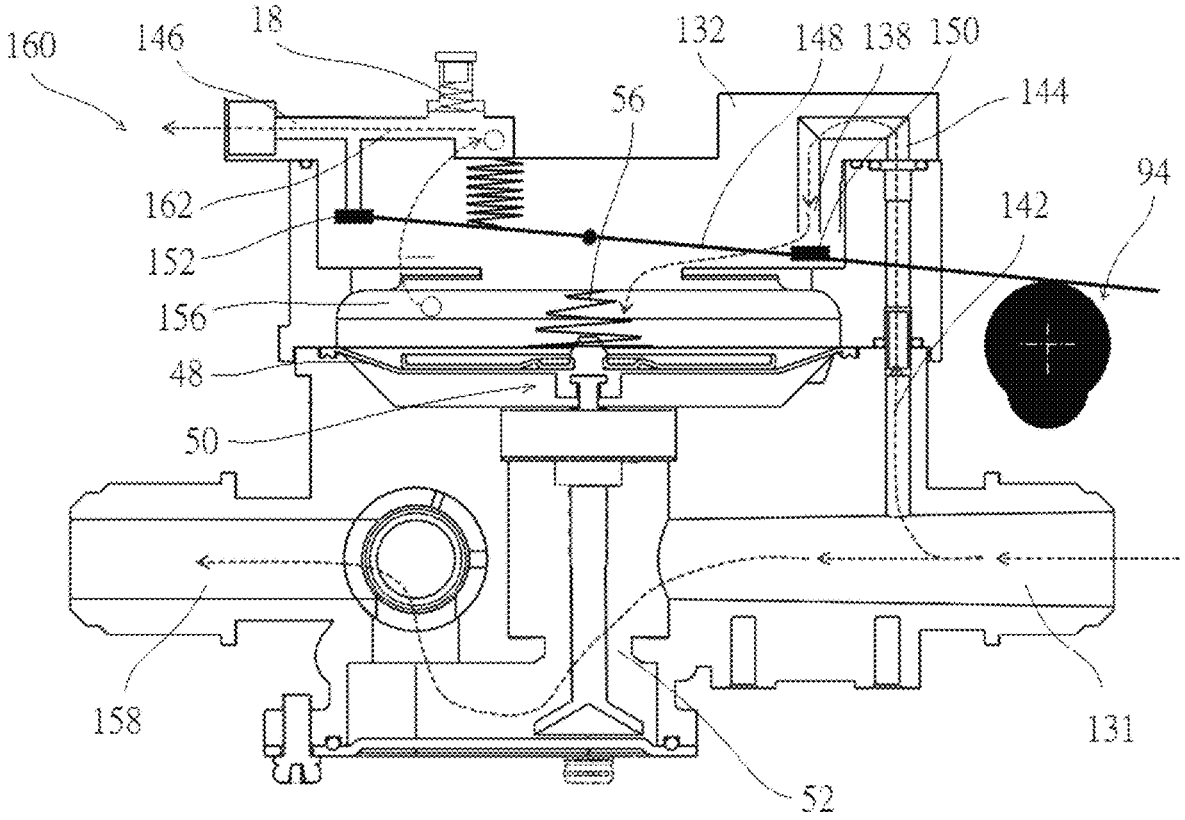
FIG. 17 is a schematic view of a ninth preferred embodiment according to the present invention.
Figure 18:
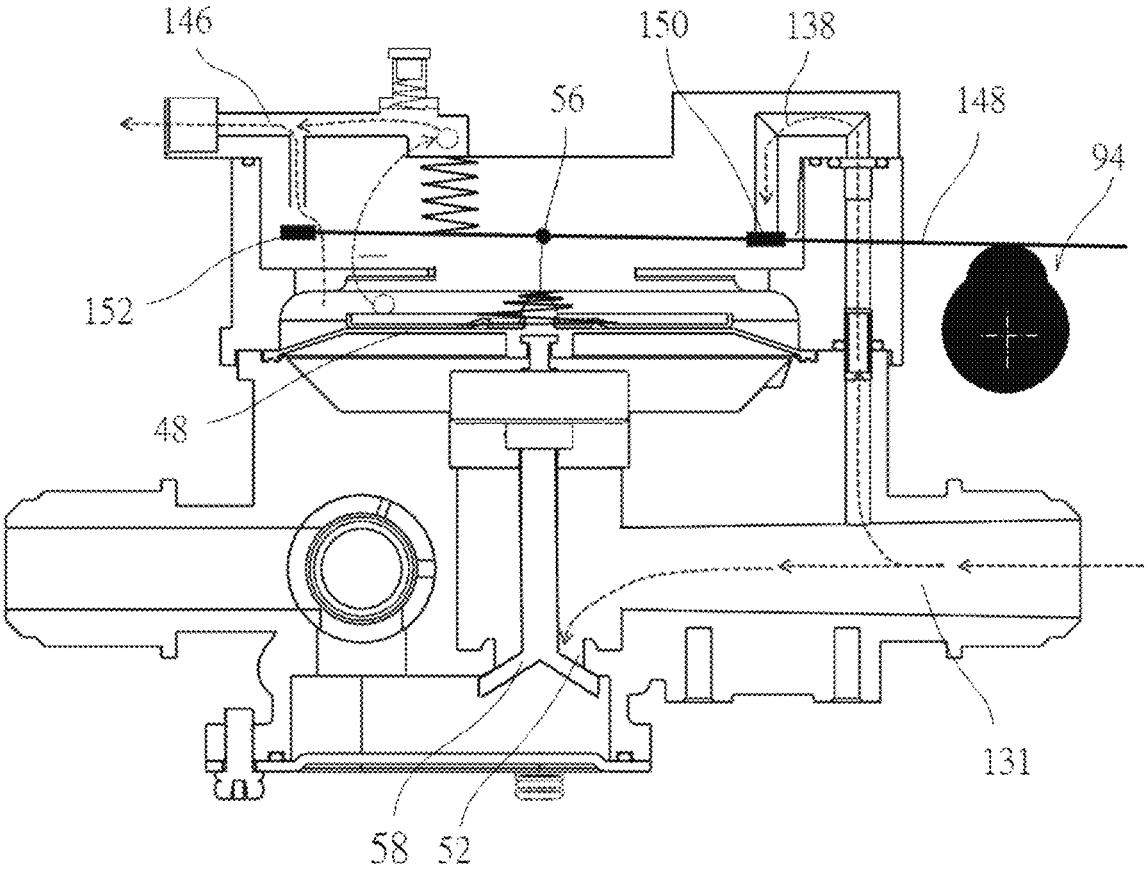
FIG. 18 is an operational view of a ninth preferred embodiment according to the present invention.

FIG. 17 and FIG. 18 show gas safety device 160 as a ninth preferred embodiment of the present invention. Its configuration is similar to gas safety device 130, with the following difference: There is no second gas outlet end 139 inside the controller 132. The back pressure regulator 18 is connected to one end of the controller gas outlet 146 through a pressure-relief flow channel 162. The pressure-relief flow channel 162 is connected to the internal side of the cover plate 156. The spring 56 of the valve body 50 is a compressed spring, having a pulling force to recover its original state, located between the cover plate 156 and the diaphragm 48, and used to enable the second valve portion 58 to close the valve 52 when the diaphragm 48 is not pushed by the gas back pressure. The end of the micro switch lever 148 sticking out of the controller 132 is located on one end of first valve portion 150.

Thus, when the driver 92 is timed, the micro switch lever 148 is not pushed by the drive piece 94, the controller gas outlet 146 is closed by the third valve portion 152, while the first gas outlet end 138 is not closed by the first valve portion 150, gas from the gas inlet flow channel 131 will pass through the controller gas inlet 142 and the internal pathway 144, and flow to the internal side of the cover plate 156 from the first gas outlet end 138. The gas on the internal side of the cover plate 156 will then pass through the pressure-relief flow channel 162 and flow out from the controller gas outlet 146, while the gas flow in from the gas inlet flow channel 131 will pass through the valve 52, and flow out from the other gas outlet flow channel 158.

When the set time is over, the micro switch lever 148 is pushed by the drive piece 94, so the first gas outlet end 138 is closed by the first valve portion 150, and the gas outlet channel 146 is not closed by the third valve portion 152. When there is no supply of back pressure gas, the spring 56 of the valve body 50 will pull the diaphragm 48 to rise, causing the second valve portion 58 to close the valve 52, and the gas entering from the gas inlet flow channel 131 can not flow out from the valve 52.

It is to be noted that, the driver disclosed in the present invention is not limited to the above-mentioned temperature sensor and mechanical timer. Other components such as an electronic timer with a meter or a solenoid valve can also be used to control the back pressure of the differential pressure valve, as long as there is a movable component to push or not push the micro switch lever. All such configurations will meet the need of the present invention.

To conclude, the above-mentioned controller, differential pressure regulating valve and driver constitute the present invention of a gas safety device using low power to control high flow. There are two different ways of gas input, one is from the bottom of the valve, and the other is from between the diaphragm and the valve. The driver can be used to control high flow output. Each of the controller, differential pressure regulating valve and driver can be implemented in various structural styles based on the same spirit of technology for safe usage of gas. In a word, the present invention truly has practical value.

While the means of specific embodiments in the present invention have been described by reference drawings, numerous modifications and variations could be made thereto by those skilled in the art without departing from the scope and spirit of the invention set forth in the claims. The modifications and variations should be in a range limited by the specification of the present invention.

What is claimed is:

1. A gas safety device using low power to control high flow, which includes:

a controller, including a controller gas inlet and a controller gas outlet communicated with one end of the controller gas inlet, the controller gas inlet is connected to the gas source; a micro switch lever is movably configured on the controller gas inlet, and is connected to one end of the controller gas outlet, through a first valve portion on its one end, the controller gas inlet can be controlled to be or not to be communicated with the controller gas outlet;

a differential pressure regulating valve, configured on one side of the controller, including a gas inlet flow channel, a gas outlet flow channel, a diaphragm that can be pushed by the gas pressure, and a valve body configured on one side of the diaphragm, between the gas inlet flow channel and the gas outlet flow channel, a valve is configured, the gas outlet flow channel is connected to a gas burning appliance, the diaphragm is configured on one side of the gas outlet flow channel, the other side of the diaphragm is communicated with the controller gas outlet, one end of the valve body is configured with a second valve portion, the valve body goes through a valve gate, so that the second valve portion can shut the valve or open the valve, to control if the gas inlet flow channel can be communicated with the gas outlet flow channel; and a driver, configured with a drive piece that is connected to the micro switch lever, through displacement of the drive piece to drive the micro switch lever, the first valve portion can control if the controller gas inlet can be communicated with the controller gas outlet, wherein the gas safety device further includes a back pressure regulator, connected between the controller gas outlet of the controller and the diaphragm, used to regulate the back pressure of the gas on the diaphragm.

2. The gas safety device using low power to control high flow defined in claim 1, wherein the inside of said controller gas inlet is configured with a gas inlet valve connecting to the gas source, the gas inlet flow channel is connected to the gas inlet valve, so that the gas delivered by the gas inlet valve can also flow into the gas inlet flow channel, the differential pressure regulating valve is configured with a pilot flow channel, connected to the gas inlet valve and the gas appliance.

3. The gas safety device using low power to control high flow defined in claim 1, which further includes a throttle nozzle, connected between the controller gas outlet of the controller and the diaphragm, used to regulate the gas flow toward the diaphragm.

4. The gas safety device using low power to control high flow in claim 1, wherein the valve body includes a shaft lever, one end of the shaft lever is connected to the diaphragm, the second valve portion is configured on the other end of the shaft lever, a spring is sleeved on the shaft lever and is placed between the diaphragm and one side of the gas inlet flow channel, used for the second valve portion to close the valve when the diaphragm is not pushed by the gas pressure.

5. The gas safety device using low power to control high flow defined in claim 1, wherein the controller further includes a transmission lever, with its one end pivotally connected and fixed, the other end capable of deflection, and the drive piece of the driver being pushed against the deflection end of the transmission lever, an elastic piece, pushed against one side of the transmission lever, a link, with its one end connected to the other side of the transmission lever, and the other end connected to the micro switch lever, through displacement of the drive piece to push the transmission lever, the link can push the micro switch lever, so that the first valve portion can control if the controller gas inlet can be communicated with the controller gas outlet.

6. A gas safety device using low power to control high flow, which includes:

a controller, including a controller gas inlet and a controller gas outlet communicated with one end of the controller gas inlet, the controller gas inlet is connected to the gas source; a micro switch lever is movably configured on the controller gas inlet, and is connected to one end of the controller gas outlet, through a first valve portion on its one end, the controller gas inlet can be controlled to be or not to be communicated with the controller gas outlet;

a differential pressure regulating valve, configured on one side of the controller, including a gas inlet flow channel, a gas outlet flow channel, a diaphragm that can be pushed by the gas pressure, and a valve body configured on one side of the diaphragm, between the gas inlet flow channel and the gas outlet flow channel, a valve is configured, the gas outlet flow channel is connected to a gas burning appliance, the diaphragm is configured on one side of the gas outlet flow channel, the other side of the diaphragm is communicated with the controller gas outlet, one end of the valve body is configured with a second valve portion, the valve body goes through a valve gate, so that the second valve portion can shut the valve or open the valve, to control if the gas inlet flow channel can be communicated with the gas outlet flow channel; and a driver, configured with a drive piece that is connected to the micro switch lever, through displacement of the drive piece to drive the micro switch lever, the first valve portion can control if the controller gas inlet can be communicated with the controller gas outlet, wherein the gas safety device further includes a throttle nozzle, connected between the controller gas outlet of the controller and the diaphragm, used to regulate the gas flow toward the diaphragm.

7. A gas safety device using low power to control high flow, which includes:

a controller, including a controller gas inlet and a controller gas outlet communicated with one end of the controller gas inlet, the controller gas inlet is connected to the gas source; a micro switch lever is movably configured on the controller gas inlet, and is connected to one end of the controller gas outlet, through a first valve portion on its one end, the controller gas inlet can be controlled to be or not to be communicated with the controller gas outlet;

a differential pressure regulating valve, configured on one side of the controller, including a gas inlet flow channel, a gas outlet flow channel, a diaphragm that can be pushed by the gas pressure, and a valve body configured on one side of the diaphragm, between the gas inlet flow channel and the gas outlet flow channel, a valve is configured, the gas outlet flow channel is connected to a gas burning appliance, the diaphragm is configured on one side of the gas outlet flow channel, the other side of the diaphragm is communicated with the controller gas outlet, one end of the valve body is configured with a second valve portion, the valve body goes through a valve gate, so that the second valve portion can shut the valve or open the valve, to control if the gas inlet flow channel can be communicated with the gas outlet flow channel; and a driver, configured with a drive piece that is connected to the micro switch lever, through displacement of the drive piece to drive the micro switch lever, the first valve portion can control if the controller gas inlet can be communicated with the controller gas outlet, wherein the valve body includes a shaft lever, one end of the shaft lever is connected to the diaphragm, the second valve portion is configured on the other end of the shaft lever, a spring is sleeved on the shaft lever and is placed between the diaphragm and one side of the gas inlet flow channel, used for the second valve portion to close the valve when the diaphragm is not pushed by the gas pressure.

* * * * *